United States Patent [19]

Insko

[11] Patent Number: 5,050,328

[45] Date of Patent: Sep. 24, 1991

[54] TRIGGER LOCK

[75] Inventor: Harry I. Insko, Clearwater, Pinellas County, Fla.

[73] Assignees: Harry A. Insko; Susan W. Insko, both of Oldamar, Fla.

[21] Appl. No.: 666,360

[22] Filed: Mar. 8, 1991

[51] Int. Cl.[5] ..... F41A 17/54

[52] U.S. Cl. ..... 42/70

[58] Field of Search ..... 42/70.07, 70.11

[56] References Cited

U.S. PATENT DOCUMENTS

| | | | |
|---|---|---|---|
| 1,569,553 | 1/1926 | Lewis et al. | 42/70.07 |
| 1,686,482 | 10/1928 | Windle | 42/70.07 |
| 1,887,308 | 11/1932 | Jessup | 42/70.07 |
| 2,444,649 | 7/1948 | Jacobs | 42/70.07 |
| 2,503,953 | 4/1950 | Lind | 42/70.07 |
| 2,505,227 | 4/1950 | Charters | 42/70.07 |
| 2,512,140 | 6/1950 | Childs et al. | 42/70.07 |
| 2,590,516 | 3/1952 | De von Breymann | 42/70.07 |
| 2,598,924 | 6/1952 | Lind | 42/70.07 |
| 2,599,132 | 6/1952 | Sass | 42/70.07 |
| 2,664,658 | 1/1954 | Bjorklund | 42/70.07 |
| 2,742,726 | 4/1956 | Feller | 42/70.07 |
| 2,882,636 | 4/1959 | Shinaver | 42/70.07 |
| 2,893,152 | 7/1959 | Peluso | 42/70.07 |
| 3,020,663 | 2/1962 | Newson | 42/70.07 |
| 3,031,787 | 5/1962 | Womble, Jr. | 42/70.07 |
| 3,066,433 | 12/1962 | Rogers et al. | 42/70.07 |
| 3,139,694 | 7/1964 | Schaefer | 42/70.07 |
| 3,164,919 | 1/1965 | Hall | 42/70.07 |
| 3,257,695 | 6/1966 | Frame | 24/459 |
| 3,392,471 | 7/1968 | Foote | 42/70.07 |
| 3,422,560 | 1/1969 | Foote et al. | 42/70.07 |
| 3,616,559 | 11/1971 | Sobolewski | 42/70.07 |
| 3,624,945 | 12/1971 | Foote | 42/70.07 |
| 3,732,641 | 5/1973 | Adajian | 42/70.07 |
| 3,956,842 | 5/1976 | Ballenger | 42/70.07 |
| 4,030,221 | 6/1977 | Doobenen et al. | 42/70.07 |
| 4,244,083 | 1/1981 | Aremka et al. | 24/459 |
| 4,393,561 | 7/1983 | Yuda | 24/305 |
| 4,499,681 | 2/1985 | Bako et al. | 42/70.07 |
| 4,509,281 | 4/1985 | Dreiling et al. | 42/70.07 |
| 4,723,370 | 2/1988 | Sheehan | 42/70.07 |
| 4,878,702 | 11/1989 | Madsen et al. | 29/463 |
| 4,916,842 | 4/1990 | Hardy | 42/70.07 |
| 4,934,083 | 6/1990 | Smith | 42/70.07 |
| 4,945,665 | 8/1990 | Nelson | 42/70.07 |
| 4,995,180 | 2/1991 | Tucker et al. | 42/70.07 |

FOREIGN PATENT DOCUMENTS

| | | | |
|---|---|---|---|
| 100975 | 8/1923 | Switzerland | 42/70.07 |
| 138331 | 12/1952 | Switzerland | 42/70.07 |
| 1290330 | 9/1972 | United Kingdom | 42/70.07 |

*Primary Examiner*—Richard W. Wendtland

*Attorney, Agent, or Firm*—Pettis & McDonald

[57] ABSTRACT

The present invention relates to a trigger lock that is attachable to the trigger of firearms to prevent accidental discharge. The trigger lock comprises a pair of spaced apart pins that are attached to and extend normally from a plate, the pins being sized and configured to be received by axial apertures within a pair of cylinders that are attached in spaced apart relation and generally normal to the first side of a base. A pair of second apertures extend from the second side of the base to intersect respective first apertures. The second apertures have a larger circumference than the first apertures to define a ledge at each intersection. A nub is attached to at least one pin proximal to the free end of that pin and the nub is releasably engageable with the ledge within the cylinder locking the pins in the cylinders.

14 Claims, 1 Drawing Sheet

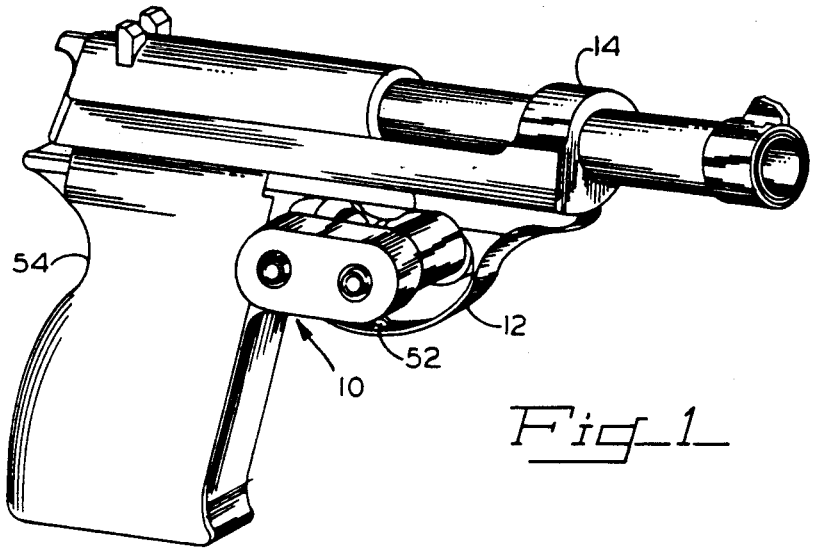
Fig_1_
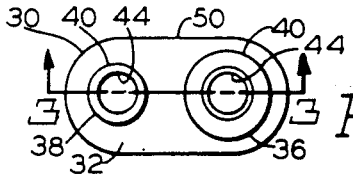
Fig_2_
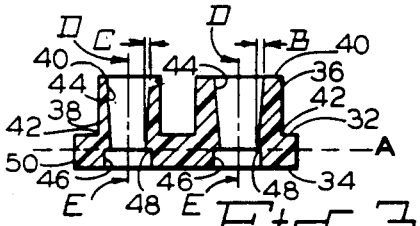
Fig_3_
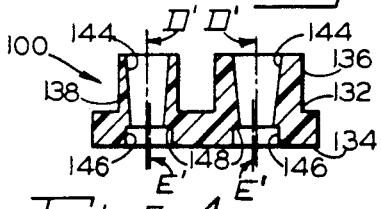
Fig_4_
Fig_5_
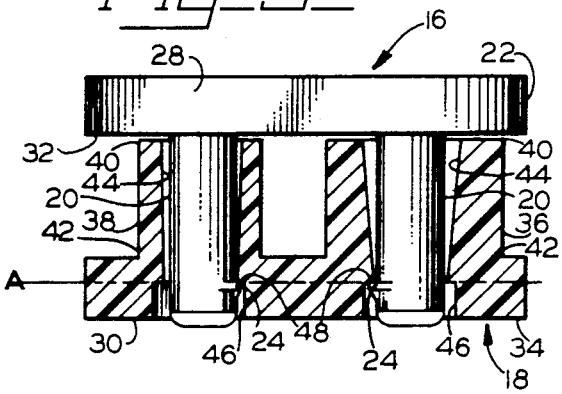
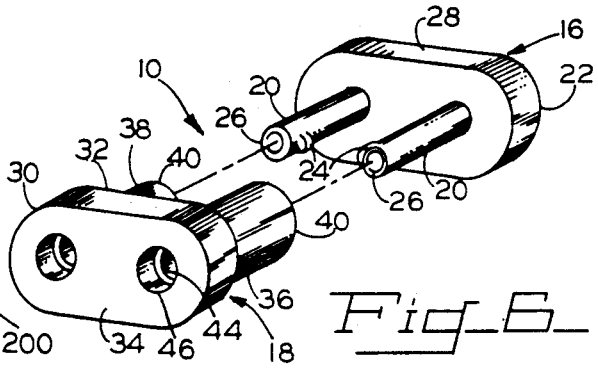
Fig_6_
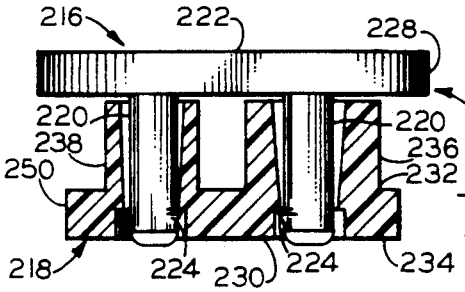
Fig_7_

TRIGGER LOCK

BACKGROUND OF THE INVENTION

1. Field of the Invention

The present invention relates to a trigger lock for firearms that is attached externally to the firearm to prevent accidental discharge.

2. Description of the Prior Art

It is certainly well known that firearms are dangerous and require safety measures to prevent firing by accidental activation of the trigger mechanisms. Most current trigger locks clamp to the trigger guard utilizing screws, spring lock engaging systems or key locks; these systems require tools or keys for attachment and removal. Such devices are disclosed by U.S. Pat. Nos. issued to Jacobs, 2,444,649; Lind, 2,503,953; Charters, 2,505,227; and Childs, 2,512,140.

It is clear that there is a requirement for a simple, effective and yet less cumbersome locking system than those cited. In particular, what is needed is a locking system that may be installed without the use of tools or a key and yet securely prevent movement of the trigger to prevent the accidental firing of the weapon.

SUMMARY OF THE INVENTION

The present invention relates to a trigger lock that may be attached to firearms to prevent accidental engagement and movement of the trigger, which would result in an accidental firing of the weapon. The trigger lock brackets the trigger to restrain the trigger's movement preventing the trigger from reaching the firing position.

Most simply stated, the trigger lock of this invention comprises a bolt means and a receiver means. The bolt means further comprises a pair of pins that are attached to a plate in a spaced apart relationship, with at least one pin having a nub in spaced apart relation with the plate. The receiver comprises two cylinders with one end of each cylinder being attached in spaced apart relation to a base and the other ends remaining free. A first axial aperture extends a predetermined distance into each cylinder from their free ends. A second axial aperture extends a predetermined distance from the second side of the base toward respective first ends of each cylinder, whereupon the first and second apertures intersect. A ledge is formed within the cylinders at the intersection of the apertures by offsetting the axes of each pair of first and second apertures and by forming the second aperture with a larger circumference than the first aperture. The pins and the receiver are dimensioned and configured so that upon insertion of the pins into the first apertures, the pins are biased outwardly from one another. The pins spring back toward one another after the nub passes the ledge causing the nub to engage the ledge.

The bolt is released from the receiver by spreading the pins apart so that the nub is disengaged from the ledge. After disengagement occurs, the pins may be easily pulled from the receiver.

The trigger lock is installed on a firearm by inserting the receiver within the trigger guard of the firearms so that the trigger rests between the two cylinders of the receiver. The pins with the plate attached are then inserted within the receiver until the nub engages the ledge and is thus locked in place.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding o the nature and objects of the invention, reference should be had to the following detailed description taken in connection with the accompanying drawings, in which:

FIG. 1 is a perspective view of the Trigger Lock installed on a typical firearm.

FIG. 2 is a top plan view of a first preferred embodiment of the receiver of the Trigger Lock.

FIG. 3 is a cross sectional elevation of a first preferred embodiment of the receiver of the Trigger Lock taken along line 3—3 of FIG. 2.

FIG. 4 is a cross sectional view similar to that of FIG. 3, but of a second preferred embodiment of the receiver of the Trigger Lock.

FIG. 5 is a front elevation of a first preferred embodiment of the Trigger Lock showing the receiver in cross section.

FIG. 6 is an exploded perspective view of a first preferred embodiment of the Trigger Lock.

FIG. 7 is a front elevation of a third preferred embodiment showing the receiver in cross section.

Similar reference characters refer to similar parts throughout the several views of the drawings.

DETAILED DESCRIPTION

A first preferred embodiment for the trigger lock of this invention is illustrated in the drawing FIGS. 1, 2, 3, 5, and 6, in which the trigger lock is shown generally as 10. FIG. 4 illustrates a second preferred embodiment of the trigger lock and is shown generally as 100; all parts similar to those parts of the first preferred embodiment will have the same reference characters in the 100 series. FIG. 7 illustrates a third preferred embodiment with the trigger lock shown generally as 200, and all parts similar to those parts of the first preferred embodiment will have the same reference characters in the 200 series.

FIG. 1 illustrates the installation of the trigger lock 10 within he trigger guard 12 of a typical firearm 14. As can be seen in FIG. 6, the trigger lock 10 is most simply comprises of a bolt means shown generally as 16 and a receiver means shown generally as 18.

The bolt means 16 further comprises a pair of pins 20 that are attached to a plate 22 is spaced apart relation to one another an generally normal to the plate 22. In the first preferred embodiment as illustrated in FIG. 6, each pin 20 has a nub 24 located in spaced apart relation from the plate 22. However, a single nub 24 attached to one pin 20 could be used as well. The nubs 24 are spaced apart from the plate 22 and are located proximal to the first ends 26 of the pins 20. The nubs face inwardly, in relation to the peripheral edge 28 of the plate 22, toward one another.

The first embodiment of the receiver means, as shown in FIG. 3 and FIG. 6, comprises a base 30 having a first side 32 and a second side 34. As can be more easily seen in FIG. 3, a first cylinder 36 and a second cylinder 38 are attached to the base 30 spaced apart from one another and attached generally normal to the first side 32 of the base 30. Each cylinder has a first end 40 and a second end 42 with the second end 42 being attached to the base 30, and the first ends 30 of the cylinders 36 and 38 remaining free. In the preferred embodiment the first cylinder 36 has a greater circumference than the second cylinder 38; however, the cylinders 36 and 38 my be the same size if desired. Each cylinder 36 and 38 has a first axial aperture 44 extending from he first end 40 of each cylinder 36 and 38 to a plane A located at a predetermined position intermediate the first ends 30 of the cylinders 36 and 38 and the second side 34 of the base 30. In the preferred embodiment the first aperture 44 in each cylinder 36 and 38 has a taper created by the circumference of the first aperture 44 at the first end 40 of each cylinder 36 and 38 being greater than the circumference of the first aperture 44 adjacent to the plane A. In the preferred embodiments the taper B of the first aperture 44 of the first cylinder 36 is generally about six degrees and the taper C of the second cylinder 38 is generally about one degree; however, these tapers may be increased or decreased depending on the size of the nubs 24, the pins 20 and the relationship of the spacing between the pins 20 and the spacing between the cylinders 36 and 38. Each cylinder 36 and 38 has a second aperture 46 that extends from the second side 34 of the base 30 to the plane A. The circumference of the second aperture 46 is greater than the circumference of the first aperture 44 adjacent to the plane A. In the preferred embodiment the first aperture 44 has an axis D therethrough and the second aperture 46 has an axis E therethrough; these axes generally coincide. A ledge 48 is defined at plane A, the plane of intersection of apertures 44 and 46, because the second apertures 46 have a greater circumference than the first apertures 44 at the plane A of intersection.

In a second embodiment illustrated in FIG. 4 the axes E' of the second apertures 146 are offset toward one another from the axes D' of the first apertures 144. The offset increases the size of the ledge 148 in the first and second cylinders 136 and 138, adjacent to the nubs 24 when the bolt means 16 is inserted in the receiver 18.

FIG. 7 illustrated a third preferred embodiment where the circumference of the peripheral edge 228 of the plate 222 is greater than the circumference of the peripheral edge 250 of the base 230. This difference in size between the base 230 and the plate 222 enables the base 230 to be received within the trigger guard 12, while the plate 222 may remain outside the trigger guard 12.

In the first preferred embodiment as shown in FIG. 5 the bolt means 16 and the receiver means 18 are dimensioned and configured such that pins 20 are received by a respective one of the first apertures 44 of the first ends 40 of the cylinders 36 and 38. The pins 20 are advanced into the first apertures 44 until the nubs 24 on each pin pass by and engage the ledges 48 within each cylinder 36 and 38.

In the preferred embodiment the cylinders 36 and 38 have a circular cross-section for more universal usage. However, the cylinders 36 and 38 may have any suitable cross-section including one to fit precisely the areas in front of and behind the trigger 52.

Having thus set forth a preferred construction for the trigger lock 10 of this invention, it is to be remembered that this is but a preferred embodiment. Attention is now invited to a description of the use of the trigger lock 10. As shown in FIG. 1 a typical firearm 14 has a trigger 52 housed within a trigger guard 12. The trigger lock 10 is separated into its two components, the bolt means 16 and the receiver means 18 as shown in FIG. 6. The receiver means 18 is inserted within the trigger guard 12 so that the trigger 52 is located between the first cylinder 36 and the second cylinder 38. The placement of the trigger 52 in relation to the trigger guard 12 will determine whether a large space will be forward of the trigger 52, requiring the larger first cylinder 36 to be placed forward of the trigger 52 as shown in FIG. 1 or the reverse. That is, when the trigger 52 is placed more forward within the trigger guard 12 the first cylinder 36, being the larger cylinder, will be placed behind the trigger 52 for a tighter fit to prevent movement of the trigger 52. After the receiver means 18 is in place, the pins 20 of the bolt means 16 are inserted into the first apertures 44 from the first end 40 of each cylinder 36 and 38. The taper B of the first cylinder 36 and the taper C of the second cylinder 38 causes the pins 20 to be spread apart as they are inserted within the first apertures 44. Therefore, when the pins are fully inserted and the nubs 24 of each pin 20 have extended beyond the ledge 48, the pins 20 will spring back toward one another so that the bolt means 16 is releasably engaged by the ledge 48 and held within the receiver means 18. Once the trigger lock 10 has engaged the trigger 52, it will not be possible for the trigger to be squeezed toward the grip 54 of the firearm 14, preventing accidental firing. The trigger lock may be removed by spreading the pins 20 and pulling on either the base 30 or the plate 22 simultaneously.

In the preferred embodiment the trigger lock 10 is comprised of plastic, however, it may be formed of any suitable material.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A trigger lock for firearms comprising:

a bolt means removably engageable with a receiver means; said bolt means comprising:

a plate;

a pair of pins attached to said plate in spaced apart relation to one another and extending normal thereto, at least one of said pins comprising a nub formed thereon in spaced apart relation to said plate; and said receiver means comprising:

a base having a first side and a second side, a first and a second cylinder, each cylinder having an axis and a first and second end, said second end of each cylinder being attached in spaced apart relation and generally normal to said first side of said base, and said first ends of said cylinders remaining free; each said cylinder having a first axial aperture extending from said first end to a plane located at a predetermined position intermediate said first ends and said second side of said base; each said cylinder further comprising a second aperture extending from said second side of said base to said plane, each said second aperture having an axis that is generally coincident to the axis of a respective one of said first apertures, said first and second apertures intersecting at said plane; said second aperture of at least one cylinder having a circumference greater than the circumference of said respective first aperture at said plane such that a ledge is defined by that circumference difference; said pins and said receiver means being dimensioned and configured such that said pins are received by a respective one of said first apertures of said receiver means and said pins being advanced into said first apertures until said nub releasably engages said ledge of a respective said cylinder, whereby, when said trigger lock is inserted within the trigger guard of a firearm, the trigger of the firearm is bracketed by said first and said second cylinders to block the trigger's normal movement.

2. A trigger lock for firearms as in claim 1 wherein said nub on one said pin extends toward said other pin, and each said pin further comprises a first end distal said plate, such that release of said pins from said receiver means is accomplished by spreading apart said first ends of said pins from one another and pulling said plate and said base apart from one another disengaging said pins from said receiving means.

3. A trigger lock for firearms as in claim 1 wherein said plate and said base each further comprise a peripheral edge, the circumference of said peripheral edge of said plate being greater than the circumference of said peripheral edge of said base.

4. A trigger lock for firearms as in claim 1 wherein the circumference of said first cylinder is greater than the circumference of said second cylinder.

5. A trigger lock for firearms as in claim 1 wherein at least one of said first apertures further comprises a taper such that the circumference of said aperture at said first end is greater than the circumference of said aperture adjacent said plane.

6. A trigger lock for firearms as in claim 1 wherein said first apertures of each said cylinder further comprises a taper such that the circumference of said first aperture at said first end of each said cylinder is greater than the circumference of said aperture adjacent said plane, one of said first apertures having a greater taper than said other first aperture.

7. A trigger lock for firearms comprising:

a bolt means removably engageable with a receiver means; said bolt means comprising:

a plate;

a pair of pins attached to said plate in spaced apart relation to one another and extending normal thereto, at least one of said pins comprising a nub formed thereon in spaced apart relation to said plate; and said receiver means comprising:

a first and a second cylinder, each cylinder having an axis and a first and second end, said second end of each cylinder being attached in spaced apart relation and generally normal to said first side of said base, and said first ends of said cylinder remaining free; each said cylinder having a first axial aperture extending from said first end to a plane located at a predetermined position intermediate said first ends of said cylinders and said second side of said base; each said cylinder further comprising a second aperture extending from said second side of said base to said plane, each said second aperture having an axis that is generally parallel to and offset from the axis of a respective one of said first apertures, said first and second apertures intersecting at said plane; a ledge within each cylinder defined by the intersection of said first aperture with said second aperture; and said bolt means and said receiver means being dimensioned and configured such that said pins are received by a respective one of said first apertures of said receiver means, and said pins being advanced into said first apertures until said nub releasably engages said ledge of a respective said cylinder, whereby, when said trigger lock is inserted within the trigger guard of a firearm, the trigger of the firearm is bracketed by said first and said second cylinders to block the tirgger's normal movement.

8. A trigger lock for firearms as in claim 7 wherein said nub on one said pin extends toward said other pin and each pin further comprises a first end distal said plate, such that release of said pins from said receiver means is accomplished by spreading apart said first ends of said pins from one another and pulling said plate and said base apart from one another disengaging said pins from said receiving means.

9. A trigger lock for firearms as in claim 7 wherein at least one of said second apertures of said receiver means has a circumference at said intersection of said first aperture with said second aperture that is greater than the circumference of said first aperture at said intersection.

10. A trigger lock for firearms as in claim 7 wherein said plate and said base each further comprise a peripheral edge, the circumference of said peripheral edge of said plate being greater than the circumference of said peripheral edge of said base.

11. A trigger lock for firearms as in claim 7 wherein the circumference of said first cylinder is greater than the circumference of said cylinder.

12. A trigger lock for firearms as in claim 7 wherein at least one of said first apertures further comprises a taper such that the circumference of said aperture at said first end of said cylinder is greater than the circumference of said aperture adjacent said plane.

13. A trigger lock for firearms as in claim 7 wherein said first apertures of each said cylinder further comprises a taper such that the circumference of said first aperture at said first end of each said cylinder is greater than the circumference of said aperture adjacent said plane one of said first aperture having a greater taper than said other first aperture.

14. A trigger lock for firearms comprising:

a bolt means removably engageable with a receiver means; said bolt means comprising;

a plate;

a pair of pins attached to said plate in spaced apart relation to one another and extending normal thereto, at least one of said pins comprising a nub formed thereon in spaced apart relation to said plate; and said receiver means comprising:

a base having a first side and a second side, said plate and said base further comprising a peripheral edge, the circumference of said peripheral edge f said plate being greater than the circumference of said peripheral edge of said base;

a first and a second cylinder, each cylinder having an axis and a first and second end, said second end of each cylinder being attache in spaced apart relation and generally normal to said first side of said base and said first ends of said cylinder remaining free, the circumference of said first cylinder being greater than the circumference of said first cylinder being greater than the circumference of said second cylinder; each said cylinder having a first axial aperture extending from said first end of each said cylinder to a plane located at a predetermined position intermediate said first ends of said cylinder and said second side of said base, said first apertures having a taper such that the circumference of each said first aperture at said first end of said cylinder is greater than the circumference of said first aperture adjacent said plane, said first aperture of said first cylinder having a greater taper than said first aperture of said second cylinder; each said cylinder further comprising a second aperture extending from said second side of said base to said plane, each said second aperture having an axis that is generally parallel to and offset from the axis of a respective one of said first apertures, said first and second apertures intersecting at said plane, the circumference of each said second aperture at said intersection being greater than the circumference of a respective one of said first apertures at said intersection; a ledge within each cylinder defined by the intersection of said first aperture with said second aperture; and said bolt means and said receiver means being dimensioned and configured such that said pins are received by a respective one of said first apertures of said receiver means, and said pins being advanced into said first apertures until said nub releasably engages said ledge of a respective said cylinder, whereby, when said trigger lock is inserted within the trigger guard of a firearm, the trigger of the firearm is bracketed by said first and said second cylinders to block the trigger's normal movement, and said nub on one said pin extends toward said other pin, and each said pin further comprises a first end distal said plate such that release of said pins from said receiver means is accomplished by spreading apart said first ends of said pins from one another and pulling said plate and said base apart from one another disengaging said pins from said receiving means.

* * * * *

UNITED STATES PATENT AND TRADEMARK OFFICE

CERTIFICATE OF CORRECTION

PATENT NO. : 5,050,328

DATED : September 24, 1991

INVENTOR(S) : Harry I. Insko

It is certified that error appears in the above-identified patent and that said Letters Patent is hereby corrected as shown below:

Claim 1, column 5, line 8, "circumference" should be --circumferential--;

Claim 7, column 5, line 57, the phrase --a base having a first side and a second side;-- should begin a new paragraph after the phrase "said receiver means comprising:";

Claim 7, column 6, line 18, "tirgger's" should be --trigger's--;

Claim 8, column 6, line 21, the word --said-- should follow the words "and each";

Claim 11, column 6, line 40, the word --second-- should follow the words "the circumference of said";

Claim 13, column 6, line 51, a --,-- should be inserted immediately after the word "plane";

Claim 13, column 6, line 51, an --s-- should be added to the end of the word "aperture";

Claim 14, column 6, line 66, an --o-- should be inserted prior to the letter "f" in order to form the word --of--;

Claim 14, column 7, line 3, the letter --d-- should be added to the end of the word "attache";

Claim 14, column 7, line 5, a --,-- should be inserted immediately after the word "base"; and Claim 14, column 7, lines 8 and 9, the phrase "first cylinder being greater than the circumference of said" should be deleted.

UNITED STATES PATENT AND TRADEMARK OFFICE

CERTIFICATE OF CORRECTION

PATENT NO. : 5,050,328

DATED : September 24, 1991

INVENTOR(S) : Harry I, Insko

It is certified that error appears in the above-identified patent and that said Letters Patent is hereby corrected as shown below:

Claim 14, column 7, lines 8 and 9, the phrase "first cylinder being greater than the circumference of said" should be deleted.

Signed and Sealed this

Second Day of March, 1993

*Attest:*

STEPHEN G. KUNIN

*Attesting Officer*

*Acting Commissioner of Patents and Trademarks*